US005898354A

United States Patent [19]

Lee

[11] Patent Number: 5,898,354

[45] Date of Patent: Apr. 27, 1999

[54] MOLDING STRUCTURE FOR FLYBACK TRANSFORMER

[75] Inventor: Tae Hwan Lee, Daeku, Rep. of Korea

[73] Assignee: LG Electronics Inc., Rep. of Korea

[21] Appl. No.: 09/080,024

[22] Filed: May 15, 1998

[30] Foreign Application Priority Data

May 17, 1997 [KR] Rep. of Korea ..... 1997-10982
May 17, 1997 [KR] Rep. of Korea ..... 1997-10985
May 17, 1997 [KR] Rep. of Korea ..... 1997-10986

[51] Int. Cl.[6] ..... H01F 27/02; H01F 27/29; H01F 27/30

[52] U.S. Cl. ..... 336/96; 336/192; 336/198

[58] Field of Search ..... 336/96, 105, 107, 336/192, 198, 208, 205; 123/621, 634

[56] References Cited

U.S. PATENT DOCUMENTS 3,559,134 1/1971 Daley ..... 336/198
3,665,358 5/1972 Leuck et al. ..... 336/96
4,408,176 10/1983 Nakamura ..... 336/96

*Primary Examiner*—Thomas J. Kozma
*Attorney, Agent, or Firm*—Ostrolenk, Faber, Gerb & Soffen, LLP

[57] ABSTRACT

A molding structure for a flyback transformer is disclosed and includes a basic bobbin member having a primary coil wound on an outer circumferential surface thereof, a film guide formed on both end portions of the basic bobbin member and having a gas exhaust holes, said film guide supporting more than one insulation film wound on an outer circumferential surface of the primary coil and more than one secondary coil, a bobbin including a ferrite core insertion member having a resin receiving space portion, and a casing receiving the bobbin therein and having a lead connection portion having a lead connection portion protrusion formed on an inner circumferential surface, wherein a high voltage lead is inserted into the upper portion of the casing.

8 Claims, 7 Drawing Sheets

MOLDING STRUCTURE FOR FLYBACK TRANSFORMER

BACKGROUND OF THE INVENTION

1. Field of the Invention

The present invention relates to a molding structure for a flyback transformer, and in particular to an improved molding structure for a flyback transformer which is capable of easily molding a bobbin having coils wound thereon in the interior of a casing using an epoxy resin, etc.

2. Description of the Conventional Art

As shown in FIG. 1, in the bobbin structure of a conventional flyback transformer, a plurality of ribs 3 are co-centrally protruded from an outer circumferential surface of a basic bobbin portion 1*a* at a predetermined interval.

A low voltage coil (hereinafter called a primary coil) 2 is wound on an outer surface of a basic bobbin portion 1a between the ribs 3.

In addition, a film guide 5 having a predetermined height which is higher than that of each rib 3 is formed at both ends of the basic bobbin portion 1*a*.

An insulation film 6 having a predetermined width corresponding to the longitudinal distance of the basic bobbin portion 1*a* is wound on the outer surfaces of the primary coil 2 and the ribs 3. A high voltage coil (hereinafter called a secondary coil) is wound on the upper surface of the insulation film 6.

At this time, more than one insulation film and secondary coil may be wound on the upper surface of the secondary coil 4, respectively.

As shown in FIG. 2, there are provided a ferrite core insertion member 13 having a core contact surface 14 formed in one side thereof and an insertion portion 11 formed in the center thereof. The ferrite core insertion member 13 is formed at an end portion of the bobbin 1, namely, on the upper end portion of the coil portion 10.

When a channel-shaped ferrite core 15, which is used for inducing a secondary voltage based on the primary voltage, is inserted into the ferrite core insertion portion 11 of the ferrite core insertion member 13, a recessed portion 15*a* of the core 15 contacts with the core contact surface 14.

In addition, as shown in FIG. 3, the coils 2 and 4 and the bobbin 1 are inserted into the casing 20 in order to enable an insulation and to prevent a leakage and discharge of a high voltage, and the casing 20 and the portion between the coils and bobbin (namely, a casing space portion) are molded using an epoxy resin, etc. A lead connection portion 17*b* is formed at one end (namely, at the opposite portion of the portion in which the ferrite core insertion member 13 is formed) of the casing 20 into which the bobbin 1 is inserted.

A high voltage lead 17 is connected with a high voltage terminal 17*a* formed in the interior of the bobbin 1 and is inserted into the lead connection portion 17*b* for supplying a high voltage of an anode to the Braun tube.

At this time, when molding the casing space portion using the epoxy resin 19, a rubber bushing 18 tightly contacting with the high voltage lead 17 is engaged to the upper portion of the lead connection portion 17*b*, into which the high voltage lead 17 is inserted, in a shape that the upper portion of the lead connection portion 17*b* is surrounded so that the epoxy resin 19 is not leaked to the outside of the casing 20 in the interior of the lead connection portion 17*b*.

After the molding operation is completed, as shown in FIG. 2, the ferrite core 15 is engaged to the ferrite core insertion member 13 for thereby fabricating a flyback transformer.

In the drawings, reference numeral 16 denotes a resin which is leaked to the outside.

However, when fabricating the conventional flyback transformer, the casing space portion is molded using the epoxy resin, etc. Therefore, a predetermined gas and gas bubbles are generated due to a high temperature molding operation, so that the epoxy resin is not uniformly formed in the space portion of the casing due to the gas and bubbles.

Namely, since the casing is sealed, the epoxy resin which is provided into the interior of the casing receives a repulsive force of the air in the interior of the casing. The above operation will be explained in more detail. For example, when inserting a piston into a cylinder, since there are not any holes for exhausting the air in the cylinder to the outside, a predetermined force is generated with respect to the supply of the epoxy resin in the cylinder. Therefore, the epoxy resin is not uniformly formed between the coils and the insulation film. Due to the above-described problems, it is impossible to enable a desired insulation between coils.

In addition, when a molding operation is performed using the epoxy resin, since the epoxy resin, which is overflown, is formed on the upper surface of the core contact surface, when the core is inserted into the bobbin, the thusly overflown resin contacts with the recessed portion, so that the ferrite core may not be installed at the normal position due to the height of the overflown resin, and the electric characteristic of the product may be changed. In addition to that, a predetermined problem may occur when engaging the core.

Furthermore, in order to prevent the epoxy resin from being leaked to the outside of the casing, since a rubber bushing is additionally used, the number of fabrication processes is increased. The rubber bushing may be extended during a high temperature process and may be escaped from the lead connection portion, so that the resin may be leaked to the outside.

SUMMARY OF THE INVENTION

Accordingly, it is an object of the present invention to provide a molding structure for a flyback transformer which overcomes the problems encountered in the conventional art.

It is another object of the present invention to provide a molding structure for a flyback transformer which is capable of easily removing gas, which is generated when molding the bobbin on which coils are wound, to the outside of a casing.

It is another object of the present invention to provide a molding structure for a flyback transformer which is capable of preventing the mounting position of a core from being moved to the normal position due to the epoxy resin which is overflown on a core contact surface when molding the bobbin using an epoxy resin.

It is another object of the present invention to provide a molding structure for a flyback transformer which is capable of preventing the leakage of an epoxy resin by forming a predetermined shaped protrusion, which tightly contacts with a high voltage lead, on an inner circumferential surface of a lead connection portion formed on the upper surface of the casing without additionally using the rubber bushing.

In order to achieve the above objects, there is provided a molding structure for a flyback transformer which includes a basic bobbin member having a primary coil wound on an outer circumferential surface thereof, a film guide formed on both end portions of the basic bobbin member and having a gas exhaust holes, said film guide supporting more than one insulation film wound on an outer circumferential surface of the primary coil and more than one secondary coil, a bobbin including a ferrite core insertion member having a resin receiving space portion, and a casing receiving the bobbin therein and having a lead connection portion having a lead connection portion protrusion formed on an inner circumferential surface, wherein a high voltage lead is inserted into the upper portion of the casing.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

The flyback transformer according to the present invention will be explained with reference to the accompanying drawings.

Figure 1:
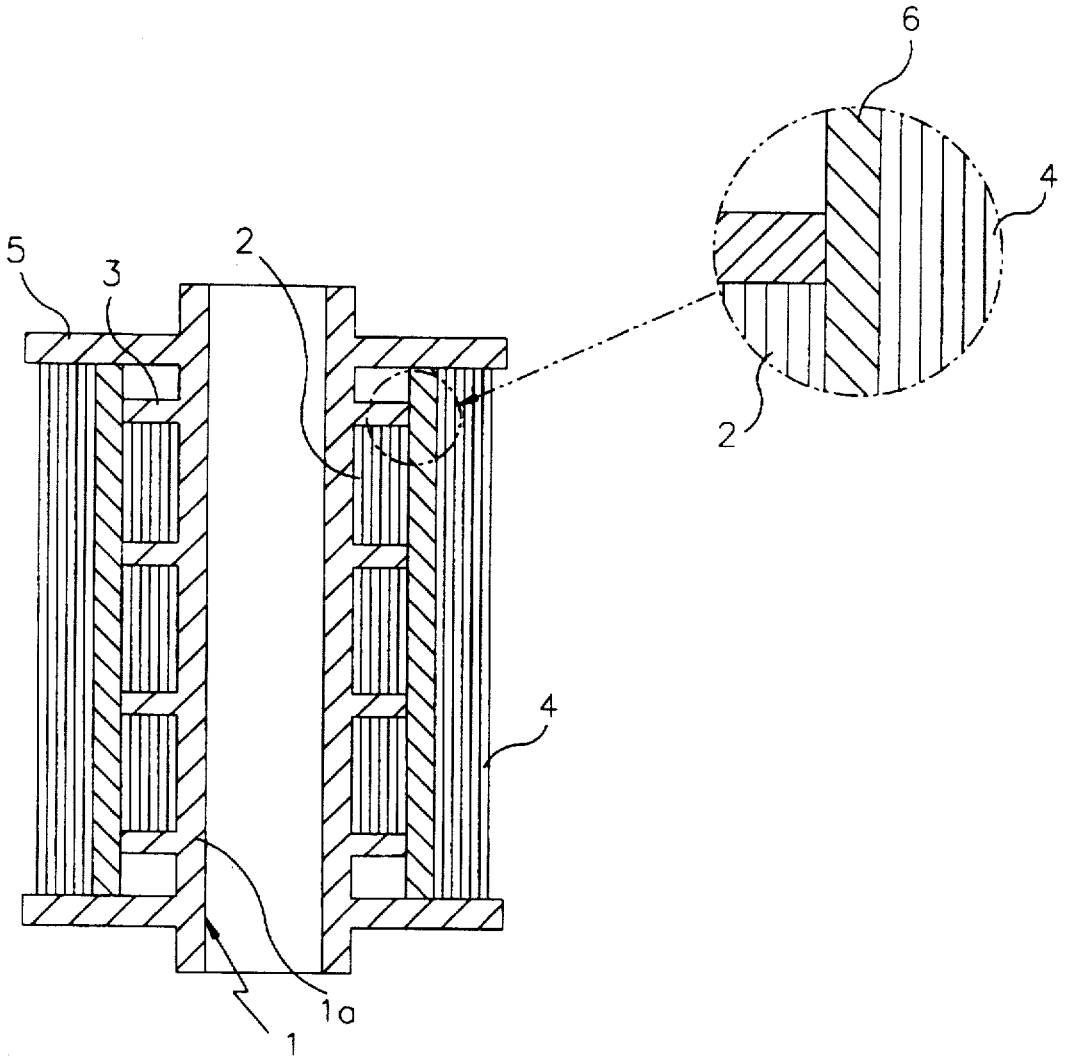
FIG. 1 CONVENTIONAL ART
FIG. 1 is a cross-sectional view illustrating a bobbin structure for a conventional flyback transformer.
Figure 2:
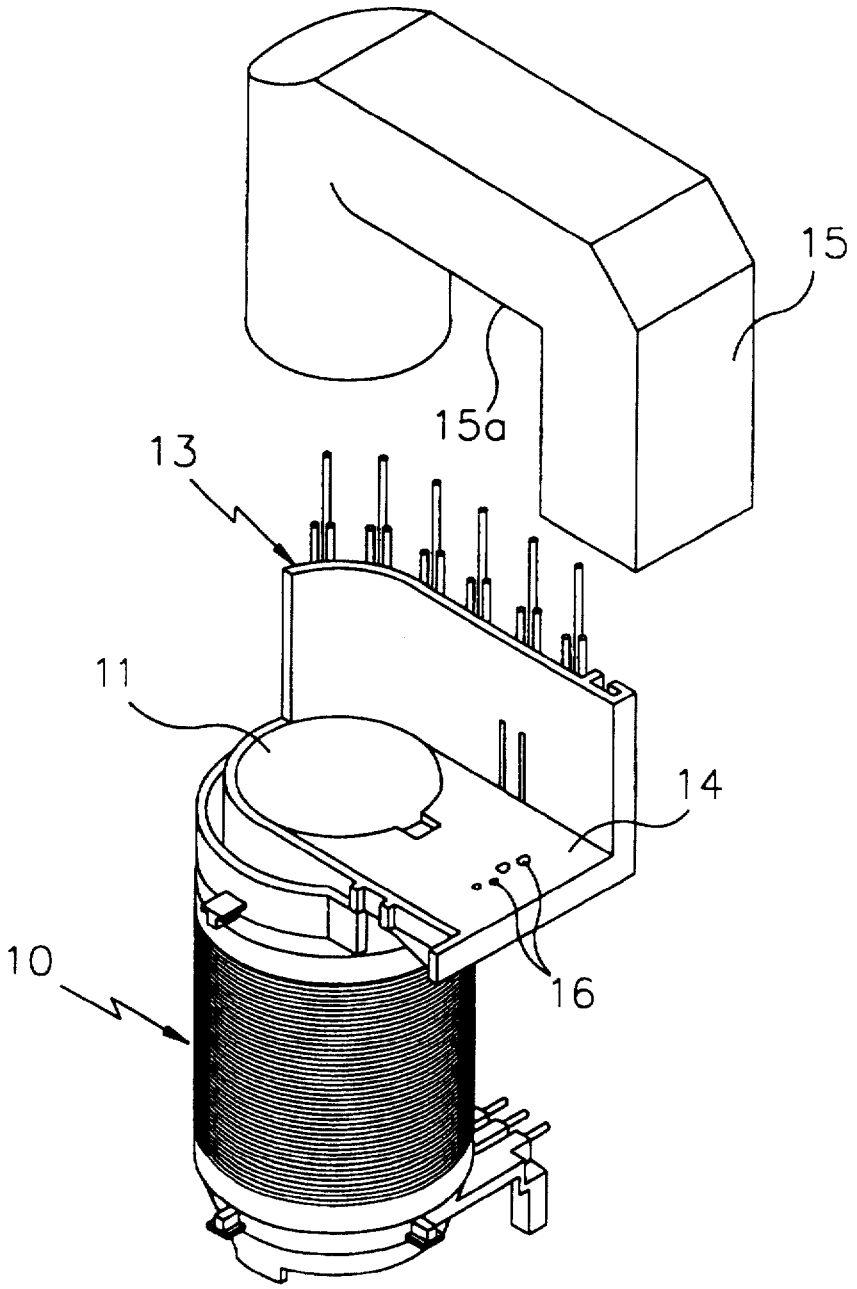
FIG.2 CONVENTIONAL ART
FIG. 2 is a partially cut-away perspective view illustrating the construction that a bobbin is molded by an epoxy resin and a ferrite core is inserted into a ferrite core insertion portion in the molding structure of a conventional flyback transformer.
Figure 3:
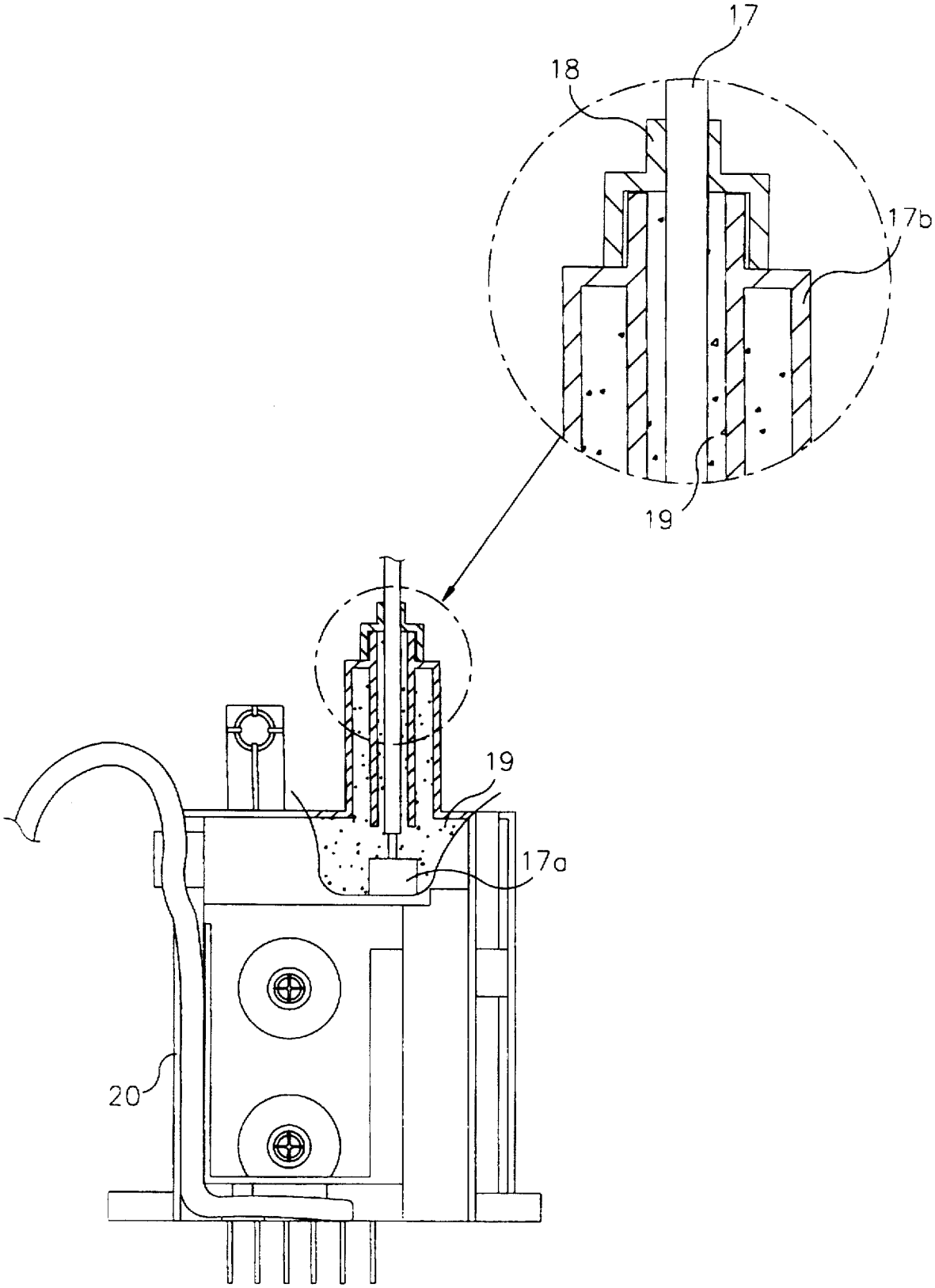
FIG.3 CONVENTIONAL ART
FIG. 3 is a partially cut-away cross-sectional view illustrating the portion into which a high voltage lead is inserted in the leakage prevention structure for the molding structure of a conventional flyback transformer.
Figure 4:
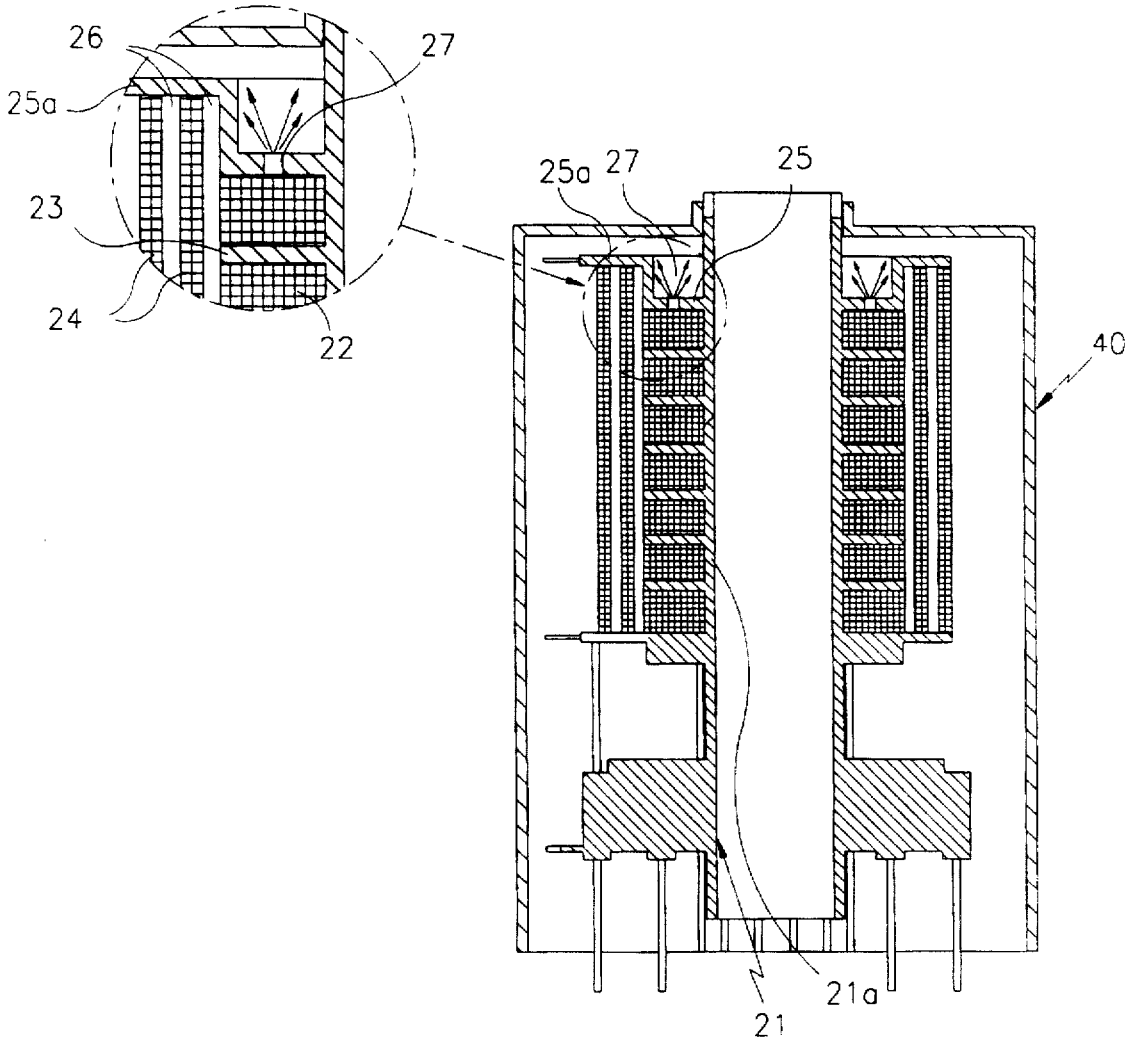
FIG. 4 is a cross-sectional view illustrating a gas exhausting structure formed in a bobbin of a molding structure of a flyback transformer according to the present invention.

As shown in FIG. 4, in the molding structure of a flyback transformer according to the present invention, a plurality of ribs 23 are formed at a regular interval on an outer circumferential surface of a hollow basic bobbin portion 21*a* in the circumferential and longitudinal directions.

A primary coil 2 is wound on an outer circumferential surface of the basic bobbin portion 21*a* between the ribs 23 in the circumferential direction.

In addition, spaced-apart film guides 25 which are longer than that of the rib 23 are formed at both ends of the bobbin. The film guides 25 have step portions 25*a*. The upper and lower ends of the insulation film 26 contact with the step portions 25*a*.

Therefore, the upper and lower ends of the insulation film 26 are correctly engaged with the bobbin 21. In addition, since the step portions 25*a* of the film guide 25 support the upper and lower ends of the insulation film 26, the insulation film 26 is co-centrally wound together with a secondary coil 24.

An insulation film 26 having the width corresponding to the longitudinal distance of the basic bobbin portion 21*a* tightly contacts with the upper portions of the ribs 23 and the step portions 25*a* of the film guide 25, respectively. A secondary coil 24 is wound on the upper surface of the insulation film 26.

At this time, more than one insulation film and the secondary coil may be repeatedly wound on the upper surface of the secondary coil 24.

Figure 5:
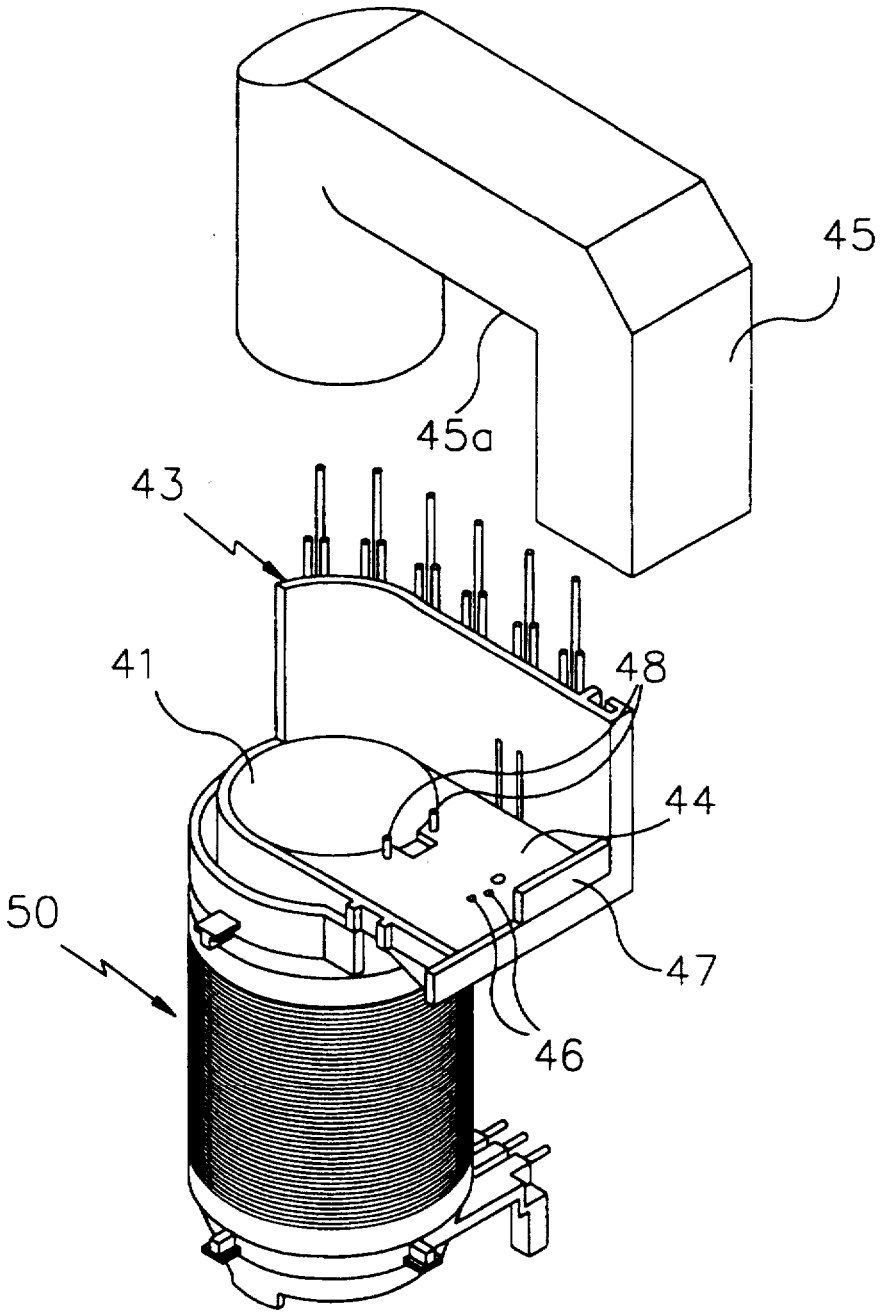
FIG. 5 is a partially cut-away perspective view illustrating the construction before a ferrite core of a molding structure of a flyback transformer according to the present invention is inserted.

As shown in FIG. 5, a ferrite core insertion member 43 having a receiving space portion 44 formed in one side and an insertion portion 41 of a ferrite core formed in the center thereof is formed on the upper portion of the coil portion 50.

Figure 6:
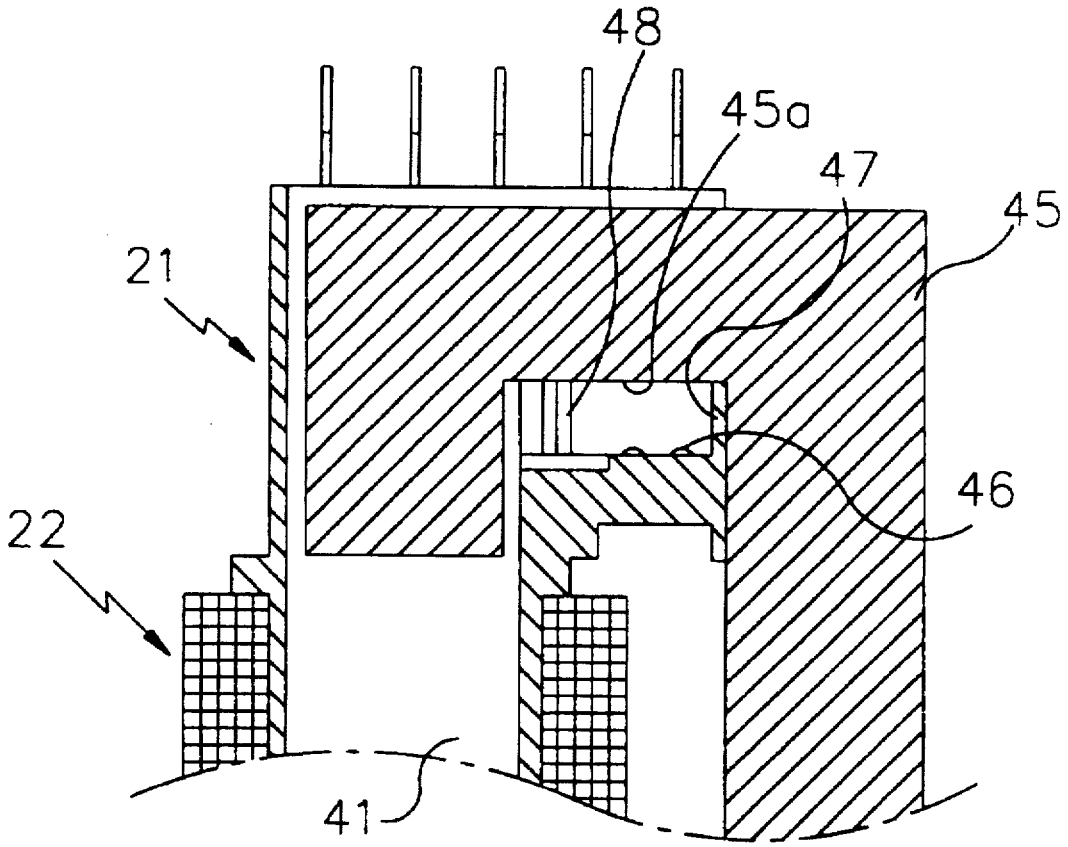
FIG. 6 is a partial cross-sectional view illustrating the construction after a ferrite core of a molding structure of a flyback transformer according to the present invention is inserted.

The thusly constituted flyback transformer bobbin is inserted into the casing 40, and the portion between the casing 40 and the coil-bobbin (casing space portion) is molded using an epoxy resin. In addition, as shown in FIGS. 5 and 6, the ferrite core 45 is inserted into the ferrite core insertion member 43 for thereby fabricating a flyback transformer according to the present invention.

Figure 7:
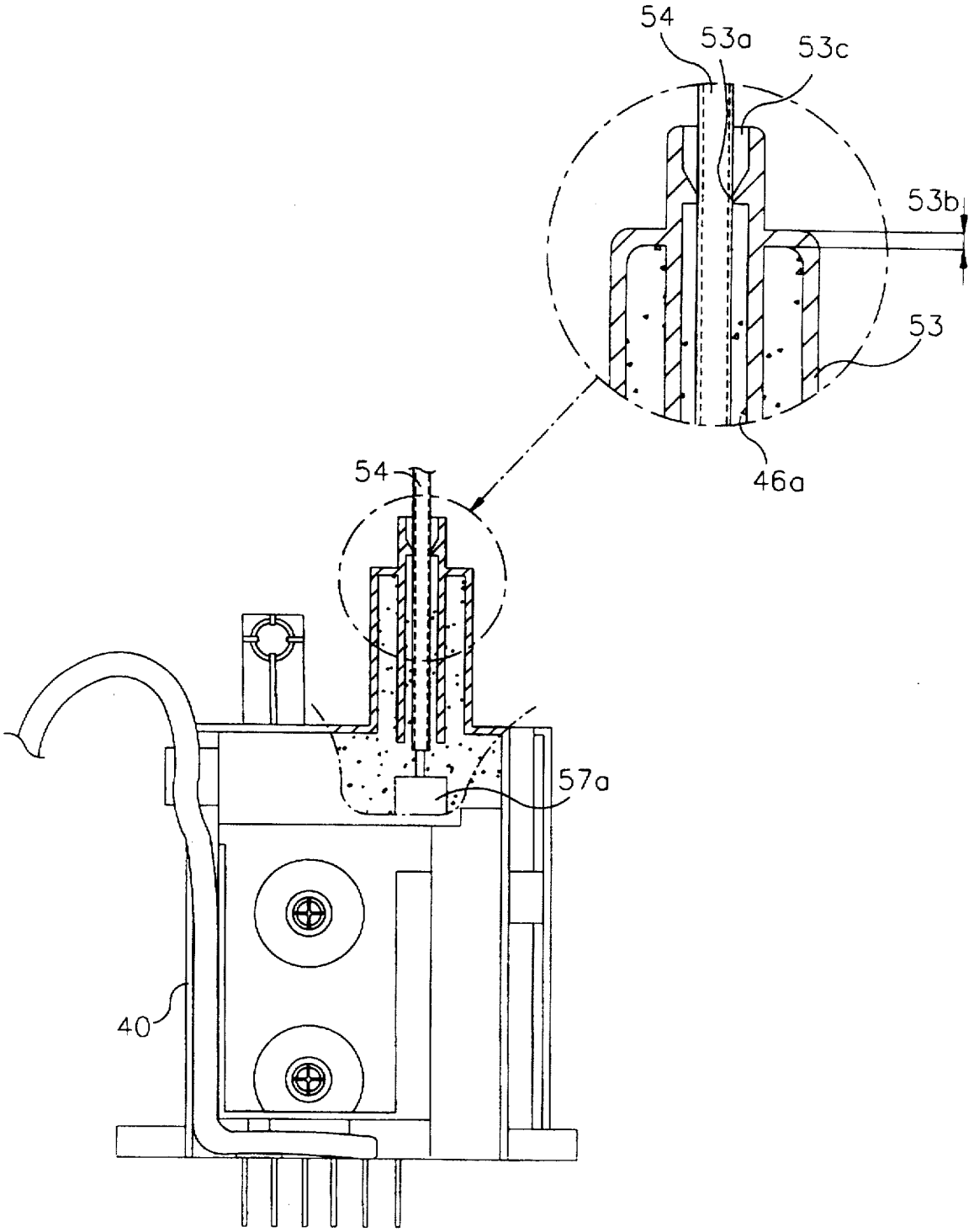
FIG. 7 is a partial cross-sectional view illustrating the portion into which a high voltage lead is inserted in a leakage prevention structure for the molding structure of a flyback transformer according to the present invention.

As shown in FIG. 7, a high voltage lead 54 coated with a rubber on its outer surface is inserted into the lead connection portion 53 formed on the upper portion of the casing 40, and the high voltage lead 54 contacts with the high voltage terminal 57*a* formed in the bobbin 21.

In another embodiment of the molding structure of the flyback transformer according to the present invention, as shown in FIG. 4, more than one gas exhausting hole 27 are formed in the film guide 25 for exhausting the gas generated when molding the casing and the coil-bobbin (casing space portion) using an epoxy resin, etc.

Therefore, the gas and gas bubbles generated when a high temperature epoxy resin is flown into the interior of the casing 40 are exhausted to the outside of the casing 40 through the gas exhausting holes 27, so that it is possible to prevent a predetermined air pressure in the casing 40 from acting as a force repulsive to the supply of the epoxy resin.

Namely, since the gas and gas bubbles generated during the molding operation are exhausted to the outside of the casing 40 through the gas exhausting hole 27, the repulsive force which interrupts the supply of the epoxy resin is decreased, so that the epoxy resin is uniformly formed between the coils 22 and 24 and the insulation film 26. In addition, the gas bubbles generated due to the gas do not exist in the interior of the casing 40 after completing the epoxy resin molding operation.

In the molding structure of the flyback transformer according to the present invention, as shown in FIG. 5, a ferrite core insertion member 43 having a receiving space portion 44 which receives the resin 46 overflown during the epoxy resin molding operation is formed in the upper surface of the coil 50.

At this time, a core contact step 47 and a plurality of core contact protrusions 48 are formed on the upper surface of the receiving space portion 44 for serving as a ferrite core support portion and thereby supporting the recessed portion 45*a* of the core 45 when a channel-shaped ferrite core 45 is inserted into the interior of the coil portion 50.

In more detail, a plurality of core contact protrusions 48 are formed in one side of the ferrite core insertion portion 41 on the upper surface of the receiving space portion 44. Each core contact protrusion 48 has a predetermined height and contacts with one end portion of the recessed portion 45*a* of the ferrite core 45, and a core contact step 47 is formed on an upper surface of the receiving space portion 44 and contacts with the recessed portion 45*a* of the ferrite core 45 at a predetermined distance from the core contact protrusion 48.

Therefore, when the ferrite core 45 is inserted into the ferrite core insertion portion 41, as shown in FIG. 6, the recessed portion 45*a* of the ferrite core 45 does not contact with the bottom of the receiving space portion 44. Namely, it contacts with the core contact protrusion 48 and the upper surface of the core contact step 47, respectively.

Therefore, even when the resin 46 is overflown to the upper surface of the receiving space portion 44 when molding the epoxy resin, since the recessed portion 45*a* of the ferrite core 45 supportedly contacts with the core contact step 47 and the upper surface of the core contact protrusion 48, respectively, when the ferrite core 45 is engaged to the bobbin 21, the ferrite core 45 is supported by the core contact protrusion 48 and the core contact step 47 irrespective of the overflow of the resin 46, so that the ferrite core 45 is correctly engaged to the receiving space portion 44 of the bobbin 21.

In addition, in the molding structure of a flyback transformer according to the present invention, a lead connection portion 53, into which a high voltage lead 54 is inserted as shown in FIG. 7, is formed in one end portion of the casing 40 (namely, in the portion opposite to the portion in which the ferrite core insertion member is formed).

At this time, the lead connection portion protrusion 53*a* is circumferentially formed on an inner surface of the lead connection portion 53, into which the high voltage lead 54 is inserted, so that the resin 46*a* is not leaked to the outside of the casing 40 through the interior of the lead connection portion 53 when molding the epoxy resin 46.

As shown in FIG. 7, the height 53*b* of the lead connection portion protrusion 53*a* has a predetermined thickness so that the lead connection portion protrusion 53*a* contacts with the rubber coated on the outer circumferential surface of the high voltage lead 54, and the diameter of the lead connection portion protrusion 53*a* is slightly smaller than the outer diameter of the high voltage lead 54 so that a stronger surface contact is enabled when the rubber portion is expanded due to the high temperature epoxy resin.

In more detail, the high voltage lead 54 is inserted into the interior of the lead connection portion 53 and contacts with the lead connection portion protrusion 53*a* for thereby being connected with the terminal 57*a*. In this state, the epoxy resin having a temperature 90° C. through 110° C. is provided into the casing 40, so that the rubber of the high voltage lead 54 is expanded in the circumferential direction.

Therefore, since the rubber of the high voltage lead 54 strongly contact with the inner circumferential surface of the lead connection portion protrusion 53*a*, the resin 46*a* is not leaked through the opening 53*c* of the high voltage lead connection portion. Namely, it is sealed within the casing 40.

In FIG. 7, the broken line represents the diameter of the high voltage lead 54 in a state that the rubber is not expanded, and the full line represents the diameter of the high voltage lead 54 in a state that the rubber is expanded.

As described above, the molding structure of the flyback transformer according to the present invention is capable of easily and uniformly forming the epoxy resin. Since the gas bubbles are effectively removed, the insulation efficiency is increased. It is possible to prevent an electric characteristic variation due to the gas bubbles. A good quality flyback transformer may be manufactured.

In addition, the ferrite core is correctly formed by preventing an incorrect mounting of the ferrite core due to the overflown resin for thereby ensuring a stable electric characteristic.

Since a rubber bushing is not additionally used for preventing the leakage of an epoxy resin, the number of fabrication and parts is decreased for thereby increasing the productivity.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A molding structure for a flyback transformer, comprising:

a basic bobbin member having a primary coil wound on an outer circumferential surface thereof;

a film guide formed on both end portions of the basic bobbin member and having a gas exhaust holes, said film guide supporting more than one insulation film wound on an outer circumferential surface of the primary coil and more than one secondary coil;

said bobbin including a ferrite core insertion member having a resin receiving space portion; and a casing receiving the bobbin therein and having a lead connection portion having a lead connection portion protrusion formed on an inner circumferential surface, wherein a high voltage lead is inserted into the upper portion of the casing.

2. The structure of claim 1, wherein the number of the gas exhaust holes is more than 1.

3. The structure of claim 1, wherein said receiving space portion includes:

a core contact step and a core contact protrusion contacting with a recessed portion of a ferrite core.

4. The structure of claim 3, wherein the number of said core contact protrusions is more than 1.

5. The structure of claim 3, wherein said core contact step is formed at one end of the receiving space portion.

6. The structure of claim 1, wherein said lead connection portion protrusion is circumferentially formed in an inner surface of the lead connection portion.

7. The structure of claim 6, wherein said protrusion has a predetermined height so that the protrusion contacts with rubber formed on an outer circumferential surface of the high voltage lead.

8. The structure of claim 6, wherein the diameter of the protrusion is slightly smaller than the outer diameter of the high voltage lead so that a surface contact is enabled by the high voltage lead by a rubber portion being circumferentially expanded by a high temperature resin.

* * * * *